US009884412B2

(12) United States Patent
Chen

(10) Patent No.: US 9,884,412 B2
(45) Date of Patent: Feb. 6, 2018

(54) RIGHT ANGLE ADAPTER WITH AN AUXILIARY HANDLE

(71) Applicant: JEI MOU INDUSTRIAL CO., LTD., Taichung (TW)

(72) Inventor: Po-Shen Chen, Taichung (TW)

(73) Assignee: JEI MOU INDUSTRIAL CO., LTD., Taichung (TW)

( * ) Notice: Subject to any disclaimer, the term of this patent is extended or adjusted under 35 U.S.C. 154(b) by 148 days.

(21) Appl. No.: 15/144,759

(22) Filed: May 2, 2016

(65) Prior Publication Data

US 2016/0325412 A1 Nov. 10, 2016

(30) Foreign Application Priority Data

May 6, 2015 (TW) ..... 104114368 A

(51) Int. Cl.
*B25B 23/00* (2006.01)
*B25G 1/06* (2006.01)
*B25G 1/04* (2006.01)

(52) U.S. Cl.
CPC ..... *B25B 23/0028* (2013.01); *B25G 1/043* (2013.01); *B25G 1/063* (2013.01)

(58) Field of Classification Search
CPC ..... B25B 23/0028; B25G 1/043; B25G 1/063
USPC ..... 81/177.2
See application file for complete search history.

(56) References Cited

U.S. PATENT DOCUMENTS 4,820,090 A * 4/1989 Chen ..... B25F 5/027 16/431
5,725,422 A * 3/1998 Leweck ..... B24B 23/005 16/426
8,132,296 B2 * 3/2012 Di Nicolantonio ..... B25F 5/026 16/426
8,407,860 B2 * 4/2013 Brennenstuhl ..... B25F 5/026 16/422
2011/0011609 A1 * 1/2011 Simm ..... B25D 17/04 173/171

* cited by examiner

*Primary Examiner* — Hadi Shakeri
(74) *Attorney, Agent, or Firm* — Bruce Stone LLP; Joseph Bruce

(57) ABSTRACT

A right angle adapter with an auxiliary handle includes a main body, an adjusting sleeve, a retaining member, a spring member and the auxiliary handle. Upon completion of angular adjustment between the auxiliary handle and the main body, and when the auxiliary handle has not pressed against the main body, the polygonal positioning recess of the adjusting sleeve is mounted and engaged with the polygonal positioning portion of the main body, so that the adjusting sleeve and the auxiliary handle are both prevented from rotating with respect to the main body, meaning that all the components are preliminarily positioned. When the auxiliary handle is screwed tight to make the abutting portion press against the driving portion of the main body, the possibility of angular change between the auxiliary handle and the main body is eliminated, thereby ensuring accurate adjustment and making angular adjustment of the auxiliary handle more convenient.

4 Claims, 11 Drawing Sheets

RIGHT ANGLE ADAPTER WITH AN AUXILIARY HANDLE

BACKGROUND OF THE INVENTION

1. Technical Field

The present invention relates to adapters for power tools, and more particularly to a right angle adapter with an auxiliary handle that is configured to work with a driving tool and a screwdriver bit.

2. Description of Related Art

For rapid screwing and unscrewing, driving tools (i.e. pneumatic or electric screwdrivers) are often used. However, when such operations have to be performed in narrow space, such as an interval between walls or where an operator may have difficulty in stretching his/her arms, there is a further need for a right angle adapter that facilitates efficient work. Moreover, in order to ensure safe operation and stable use of right angle adapters, they are always equipped with an auxiliary handle.

FIG. 1 schematically shows a conventional handle-equipped right angle adapter, which comprises a main body 11, an adjusting sleeve 12, and an auxiliary handle 13. The main body 11 has its adapting portion 111 provided with a working unit 15 for a screwdriver bit 14 to be inserted therein. A driving portion 112 connected to and driven by the adapting portion 111 has a driving unit 17 for a driving tool 16 to connect and drive, so as to drive the screwdriver bit 14 to rotate in either direction. The adjusting sleeve 12 is rotatably mounted around the main body 11. The auxiliary handle 13 has a grip portion 131 for a user's hand 18 to hold. Furthermore, a positioning portion 132 is connected to the grip portion 131 and comes apart from or presses against the main body 11. By controlling the auxiliary handle 13 to become loose or tight, the adjusting sleeve 12 is allowed to rotate freely or is driven to rotate and then be positioned. In the latter case, the relative angle between the auxiliary handle 13 and the main body 11 varies to adapt to different site requirements, thereby improving working efficiency.

Adjustment of the auxiliary handle 13 involves first unscrewing the auxiliary handle 13, aligning a positioning mark 121 on the adjusting sleeve 12 to a positioning mark 113 on the main body 11, and then screwing the auxiliary handle 13 to make a positioning portion 132 on the auxiliary handle 13 well positioned in a notch (not shown) formed on the main body 11, thereby having the adjusted angle fixed. However, when the positioning mark 121 of the adjusting sleeve 12 and the positioning mark 113 of the main body 11 come to align with each other, there is a lack of a means that preliminarily positions the adjusting sleeve 12 with respect to the main body 11. In other words, the foregoing alignment is unstable. As a result, when screwed to tight, the auxiliary handle 13 may fail to be secured on the main body 11 and bring about an angular offset between the adjusting sleeve 12 and the main body 11. For this reason, the angular adjustment of the conventional auxiliary handle 13 is somehow inconvenient and unreliable.

BRIEF SUMMARY OF THE INVENTION

The primary objective of the present invention is to provide a right angle adapter with an auxiliary handle, with the attempt to make angular adjustment of the auxiliary handle more convenient.

For achieving the aforementioned objective, the disclosed right angle adapter comprises: a main body having a driving portion, an adapting portion connected to the driving portion, a polygonal positioning portion peripherally formed around the driving portion, and a peripheral groove that is depressed from the driving portion and is farther from the adapting portion as compared to the polygonal positioning portion; an adjusting sleeve being movably and rotatably assembled to the main body, and having a socket for receiving the driving portion, a polygonal positioning recess that is depressed from an inner wall of the socket and for disengageably combining with the polygonal positioning portion, a returning recess depressed from the inner wall of the socket, and a threaded hole communicated with the socket and located between the polygonal positioning recess and the returning recess; a retaining member, being mounted around the peripheral groove of the main body and partially raised from the driving portion; a spring member, being mounted around the driving portion and providing the adjusting sleeve with a resilient returning force, the spring member having a first end abutting against the returning recess and a second end abutting against the retaining member raised from the surface of the driving portion; and the auxiliary handle, having a grip portion and an abutting portion that is connected to the grip portion and screwed into the threaded hole, wherein the abutting portion is configured to stay apart from or presses against the driving portion;

whereby, when the abutting portion of the auxiliary handle leaves from the driving portion, the auxiliary handle drives the adjusting sleeve to move away from the adapting portion of the main body, and makes the spring member accumulate a resilient returning force for later returning the adjusting sleeve, and when the polygonal positioning recess of the adjusting sleeve leaves from the polygonal positioning portion of the main body, the auxiliary handle drives the adjusting sleeve to rotate with respect to the driving portion of the main body, and when the spring member returns the adjusting sleeve, the polygonal positioning recess of the adjusting sleeve is mounted around and engaged with the polygonal positioning portion of the main body, the adjusting sleeve is prevented from rotating with respect to the driving portion of the main body, and when the abutting portion of the auxiliary handle presses against the driving portion, the auxiliary handle is prevented from driving the adjusting sleeve to move away from the adapting portion of the main body.

Preferably, the polygonal positioning portion of the main body is a dodecagonal positioning portion, and the polygonal positioning recess of the adjusting sleeve is a dodecagonal positioning recess.

Preferably, the polygonal positioning portion of the main body is an octadecagonal positioning portion, and the polygonal positioning recess of the adjusting sleeve is an octadecagonal positioning recess.

Preferably, the main body further has a limiting recess that is depressed from the driving portion and located between the polygonal positioning portion and the peripheral groove, so that when the polygonal positioning recess of the adjusting sleeve is mounted around and engaged with the polygonal positioning portion, the limiting recess allows the abutting portion of the auxiliary handle to enter thereto or retract therefrom.

DETAILED DESCRIPTION OF THE INVENTION

Figure 1:
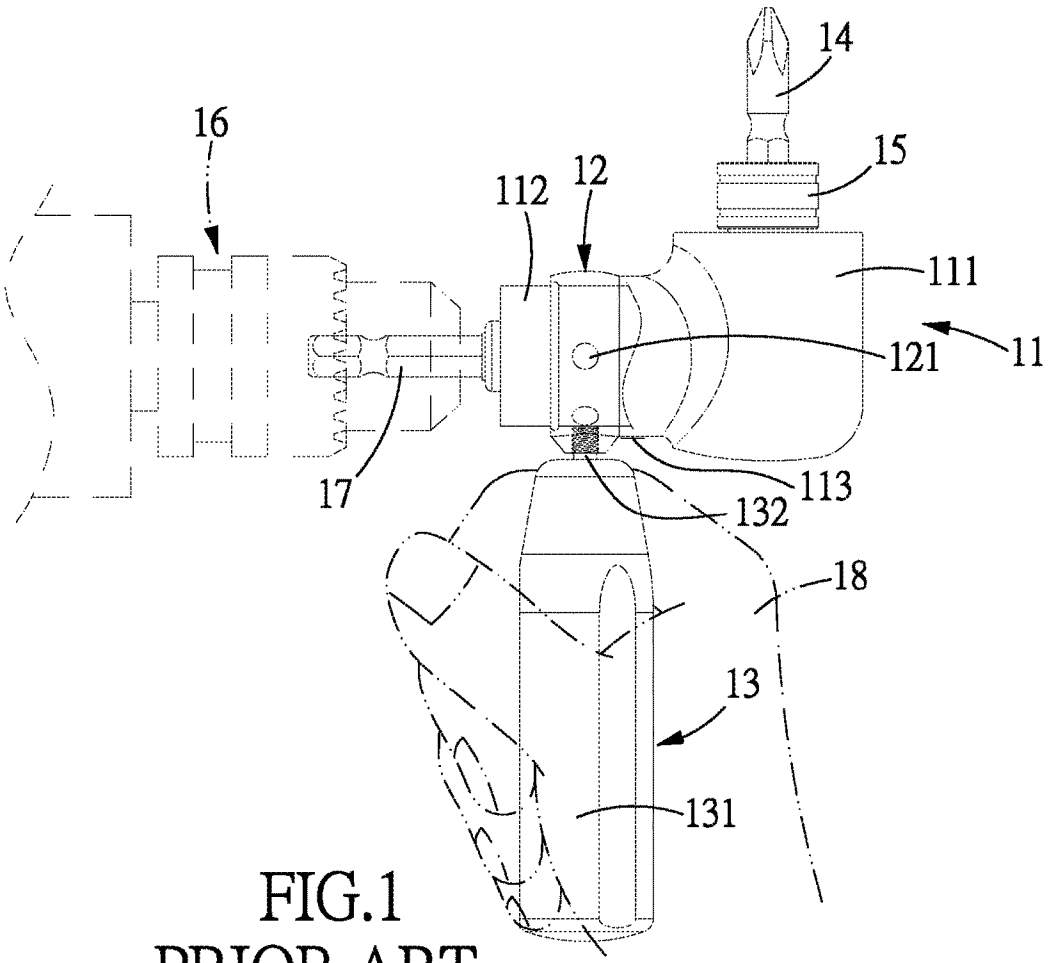
FIG.1 PRIOR ART
FIG. 1 is a schematic drawing of a conventional right angle adapter with an auxiliary handle.
Figure 2:
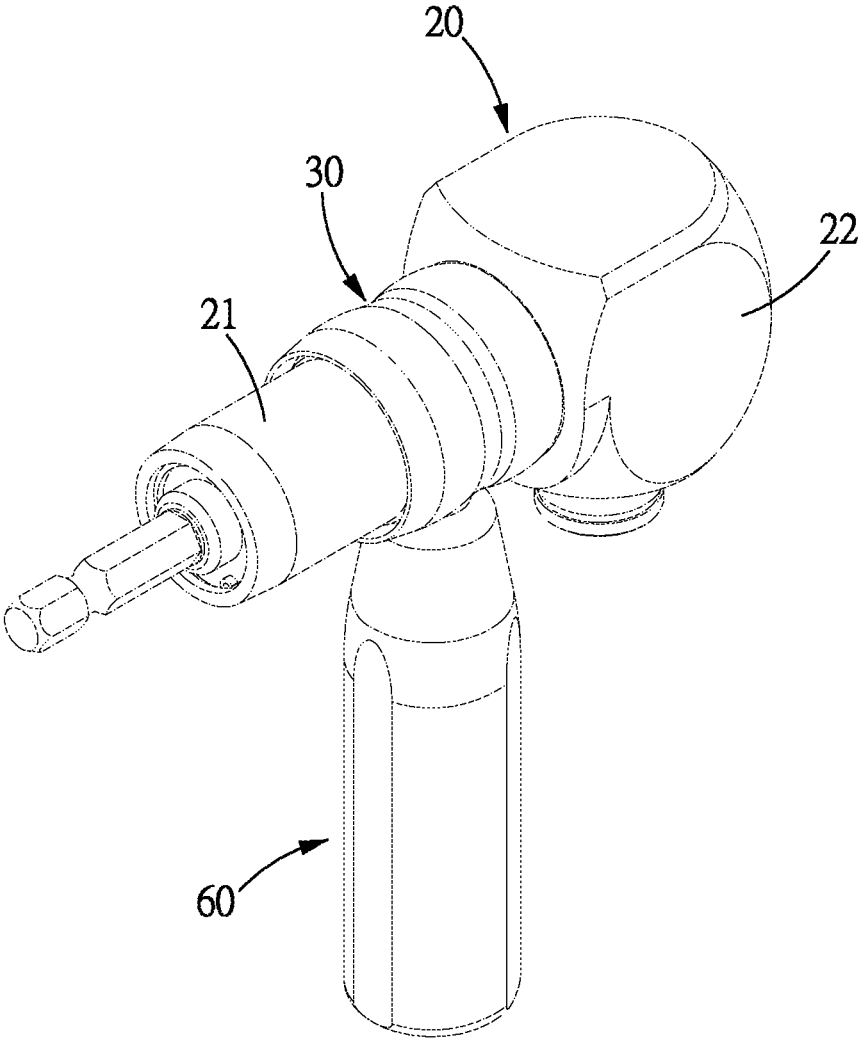
FIG. 2 is a perspective view of a first embodiment of the present invention.
Figure 3:
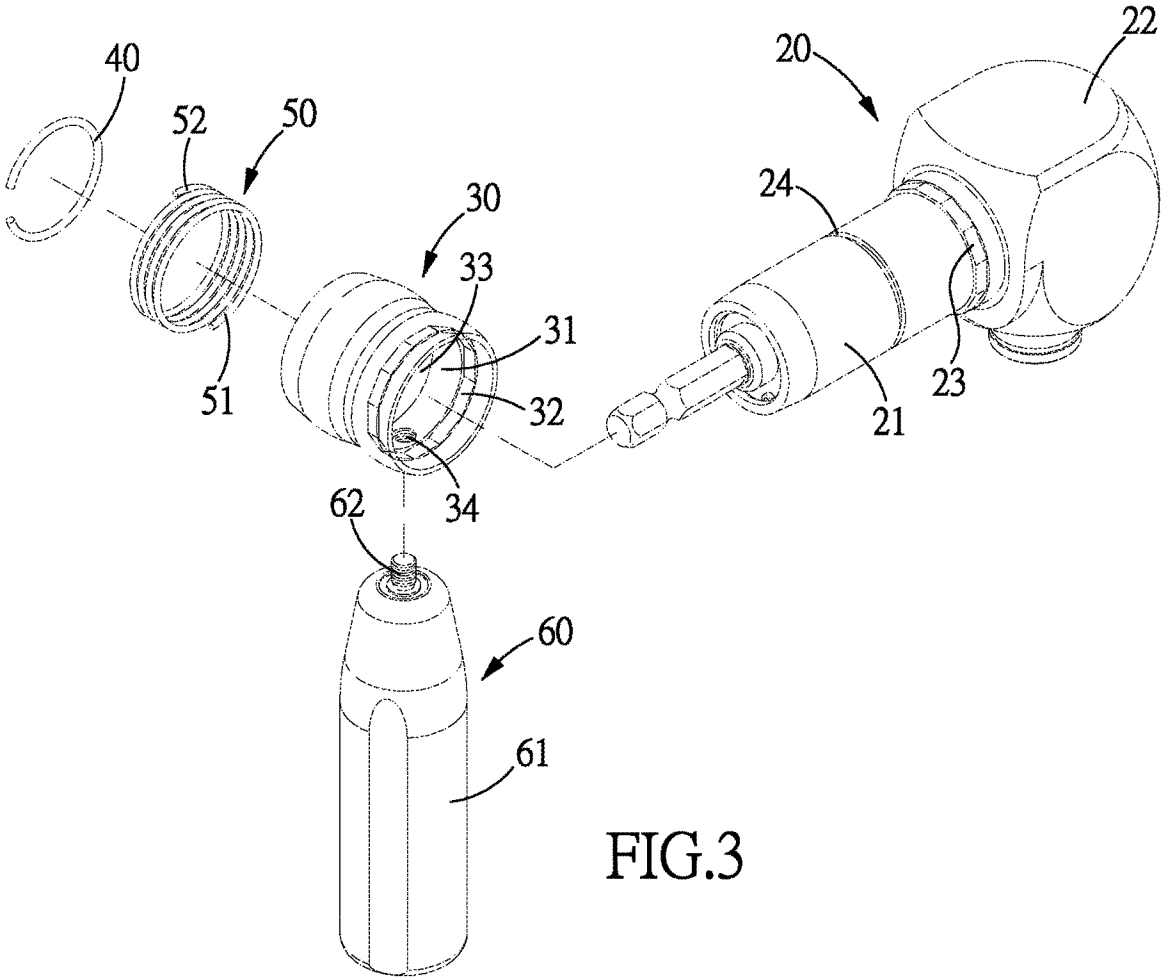
FIG. 3 is an exploded view of the first embodiment of the present invention.

As shown in FIGS. 1 through 4, in the first embodiment of the present invention, a right angle adapter with an auxiliary handle primarily comprises a main body 20, an adjusting sleeve 30, a retaining member 40, a spring member 50 and the auxiliary handle 60.

Figure 9:
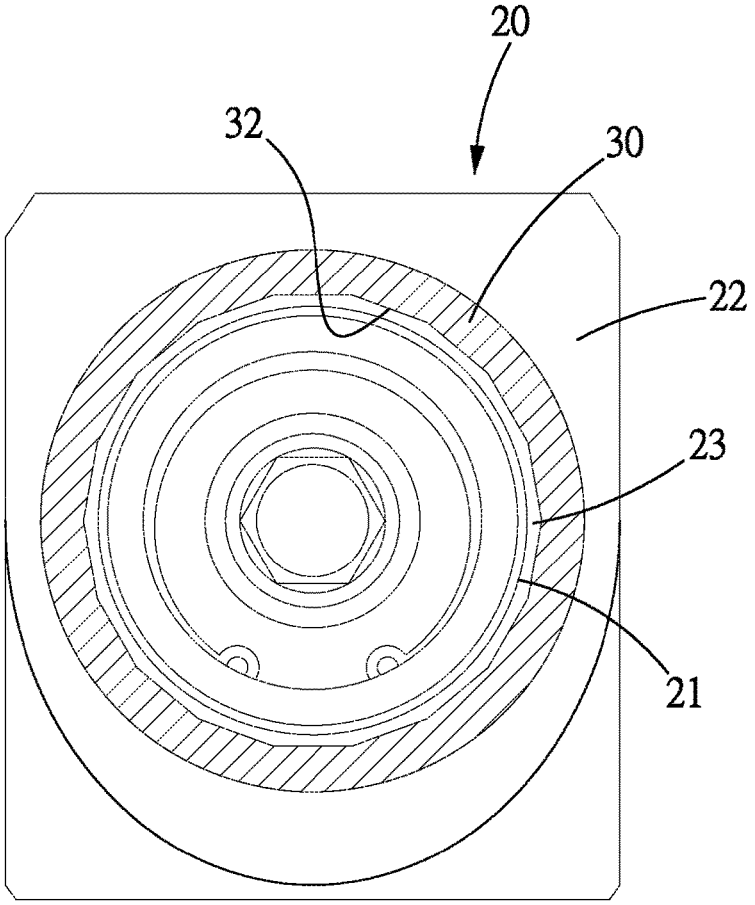
FIG. 9 is a partial, cross-sectional view of a second embodiment of the present invention, showing that the polygonal positioning portion of the main body is an octadecagonal positioning portion, and the polygonal positioning recess of the adjusting sleeve is an octadecagonal positioning recess.

The main body 20 has a driving portion 21, an adapting portion 22 connected to the driving portion 21, a polygonal positioning portion 23 peripherally formed around the driving portion 21, and a peripheral groove 24 that is depressed from the driving portion 21 and is farther from the adapting portion 22 as compared to the polygonal positioning portion 23. In the present embodiment, the driving portion 21 has a round sectional shape with its diameter slightly smaller than an outer diameter of the polygonal positioning portion 23. In addition, the polygonal positioning portion 23 of the main body 20 is herein a dodecagonal positioning portion. Alternatively, the polygonal positioning portion 23 of the main body 20 may be an octadecagonal positioning portion as shown in FIG. 9.

The adjusting sleeve 30 is movably and rotatably assembled to the main body 20, and has a socket 31 for receiving the driving portion 21, a polygonal positioning recess 32 that is depressed from an inner wall of the socket 31 and for disengageably combining with the polygonal positioning portion 23, a returning recess 33 depressed from the inner wall of the socket 31, and a threaded hole 34 communicated with the socket 31 and located between the polygonal positioning recess 32 and the returning recess 33. In the present embodiment, the polygonal positioning recess 32 of the adjusting sleeve 30 is a dodecagonal positioning recess. Alternatively, the polygonal positioning recess 32 of the adjusting sleeve 30 may be an octadecagonal positioning recess as shown in FIG. 9.

The retaining member 40 is mounted around the peripheral groove 24 of the main body 20 and is partially raised from the surface of the driving portion 21. In the present embodiment, the retaining member 40 is a C ring.

The spring member 50 is mounted around the driving portion 21 and provides the adjusting sleeve 30 with a resilient returning force. The spring member 50 has a first end 51 abutting against the returning recess 33 and a second end 52 abutting against the retaining member 40 raised from the surface of the driving portion 21. In the present embodiment, the spring member 50 is a compression spring.

The auxiliary handle 60 has a grip portion 61 and an abutting portion 62 that is connected to the grip portion 61 and screwed into the threaded hole 34. The abutting portion 62 comes apart from or presses against the surface of the driving portion 21.

When the abutting portion 62 of the auxiliary handle 60 leaves from the surface of the driving portion 21, the auxiliary handle 60 drives the adjusting sleeve 30 to move away from the adapting portion 22 of the main body 20, and let the spring member 50 accumulate a resilience that later returns the adjusting sleeve 30. When the polygonal positioning recess 32 of the adjusting sleeve 30 separates from the polygonal positioning portion 23 of the main body 20, the auxiliary handle 60 drives the adjusting sleeve 30 to rotate with respect to the driving portion 21 of the main body 20. When the spring member 50 returns the adjusting sleeve 30 to its initial position, the polygonal positioning recess 32 of the adjusting sleeve 30 engages with the polygonal positioning portion 23 of the main body 20. Consequently, the adjusting sleeve 30 is prevented from rotating with respect to the driving portion 21 of the main body 20. When the abutting portion 62 of the auxiliary handle 60 presses against the surface of the driving portion 21, the auxiliary handle 60 is prevented from driving the adjusting sleeve 30 to move away from the adapting portion 22 of the main body 20.

With the configuration as described above, the first embodiment of the present invention has the angular adjustment between the auxiliary handle and the main body performed as illustrated below.

Figure 4:
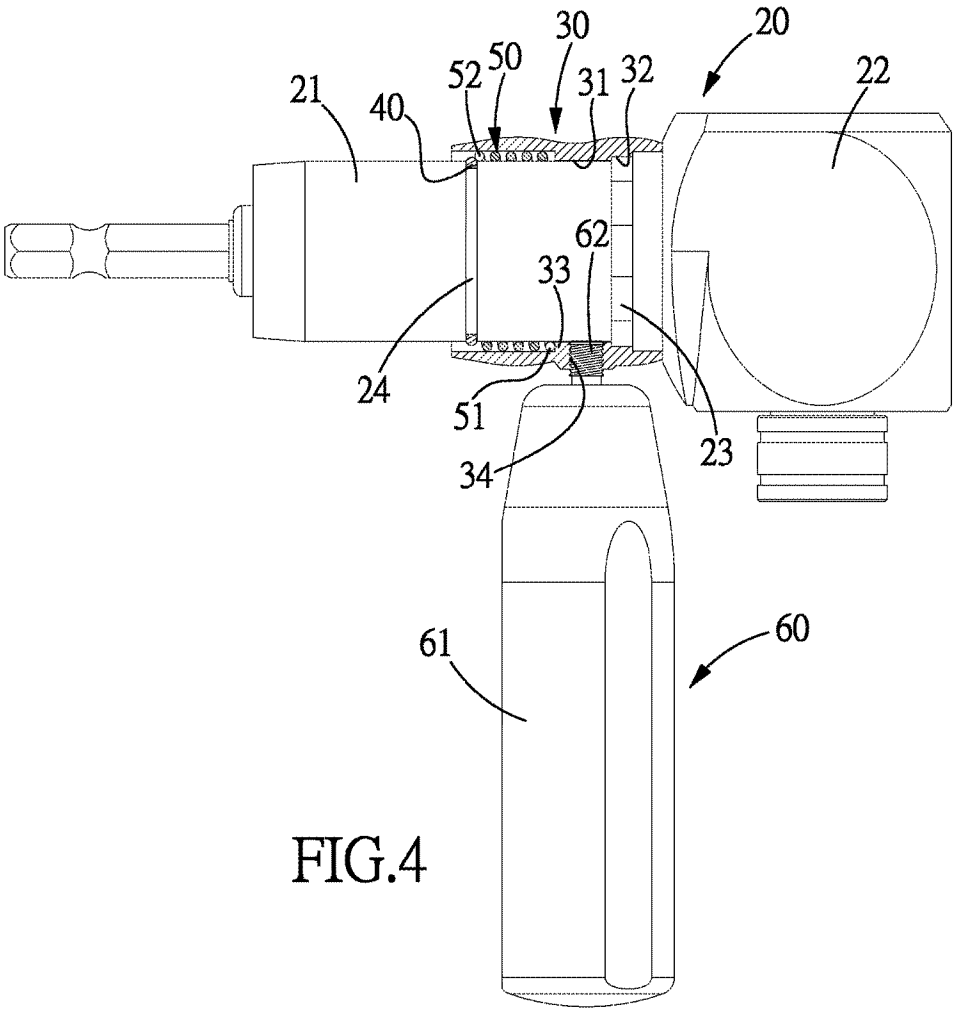
FIG. 4 is a partially sectioned view of the first embodiment of the present invention.
Figure 5:
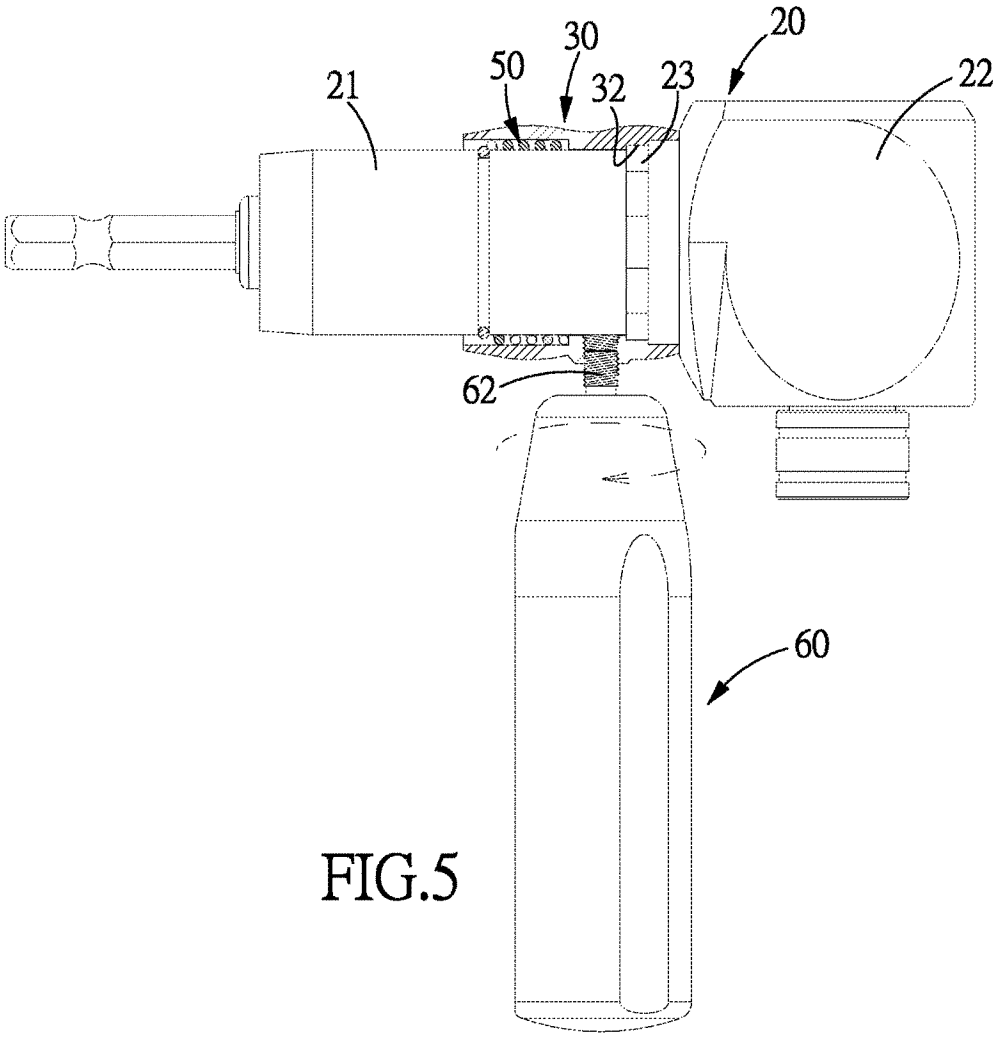
FIG. 5 is based on FIG. 4 and shows the auxiliary handle loose.

Referring to FIGS. 4 and 5, the auxiliary handle 60 is first rotated to make the abutting portion 62 leave from the surface of the driving portion 21 of the main body 20.

Figure 6:
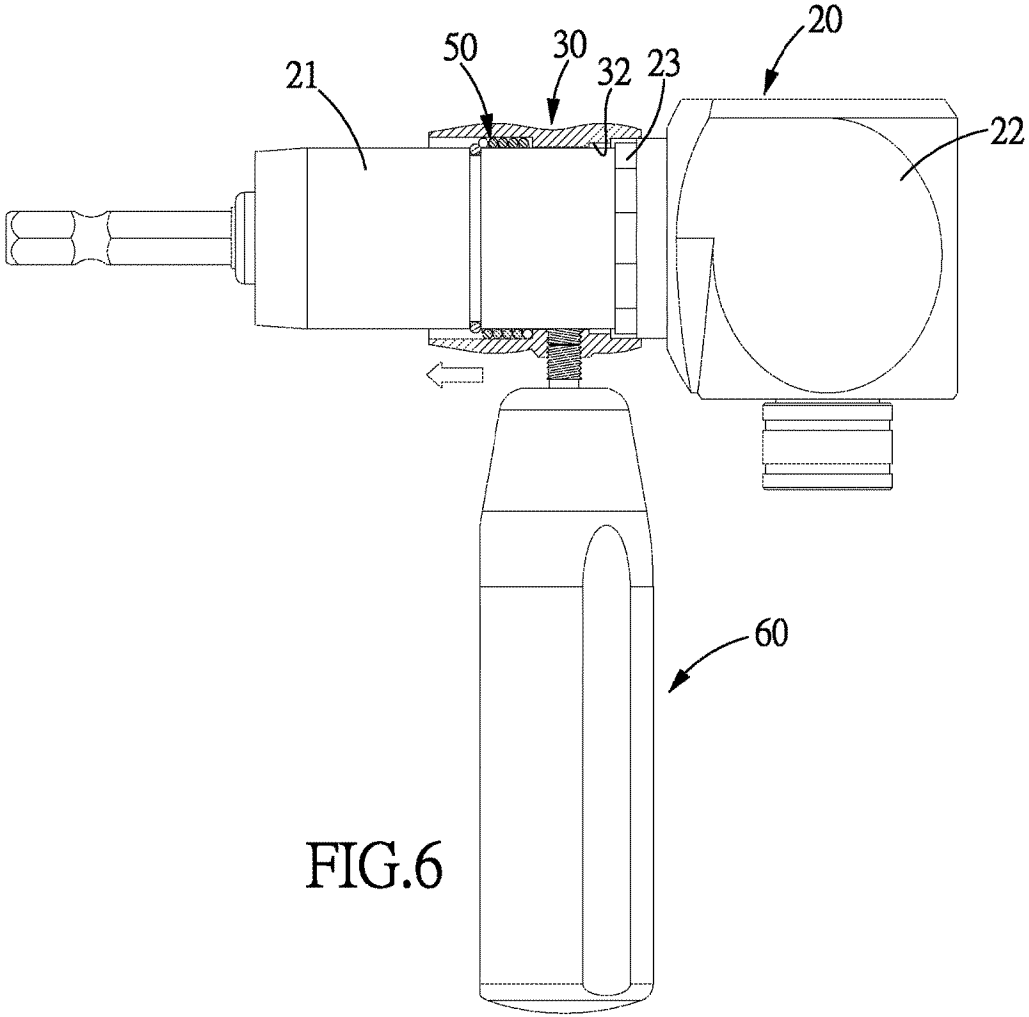
FIG. 6 is based on FIG. 4 and shows the polygonal positioning recess of the adjusting sleeve staying apart from the polygonal positioning portion of the main body.

Then, as shown in FIGS. 5 and 6, the auxiliary handle 60 is such handled that it drives the adjusting sleeve 30 to move away from the adapting portion 22 of the main body 20, to the extent that the polygonal positioning recess 32 of the adjusting sleeve 30 is fully disengaged from the polygonal positioning portion 23 of the main body 20. At this time, the adjusting sleeve 30 compresses the spring member 50, making the spring member 50 accumulate a resilience for later returning the adjusting sleeve 30.

Figure 7:
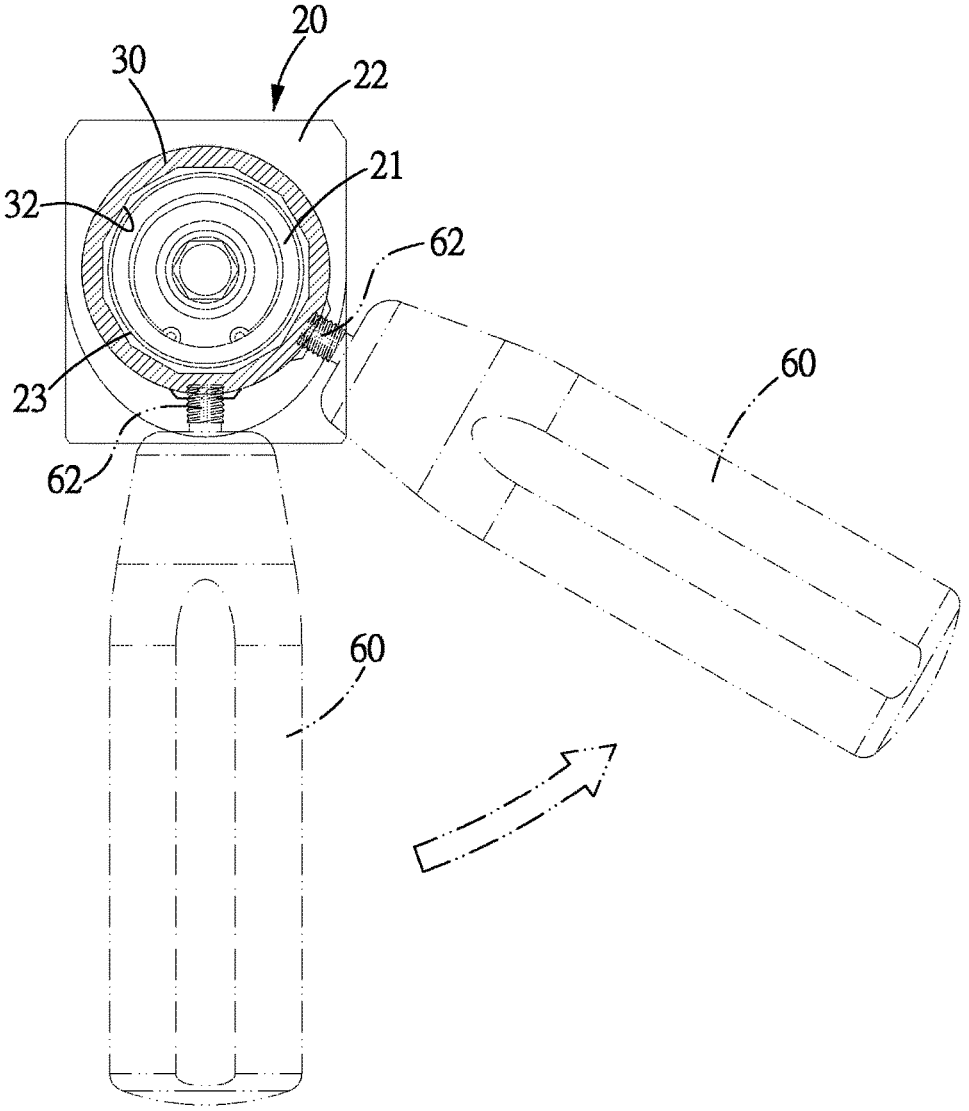
FIG. 7 is an applied view of the first embodiment of the present invention, showing that the auxiliary handle drives the adjusting sleeve to rotate for an angle.

As shown in FIGS. 6 and 7, the auxiliary handle 60 is rotated upon the driving portion 21 of the main body 20 for a desired angle. At this time, the adjusting sleeve 30 also rotate for an angle, and the spring member 50 holds the resilience for later returning the adjusting sleeve 30.

Figure 8:
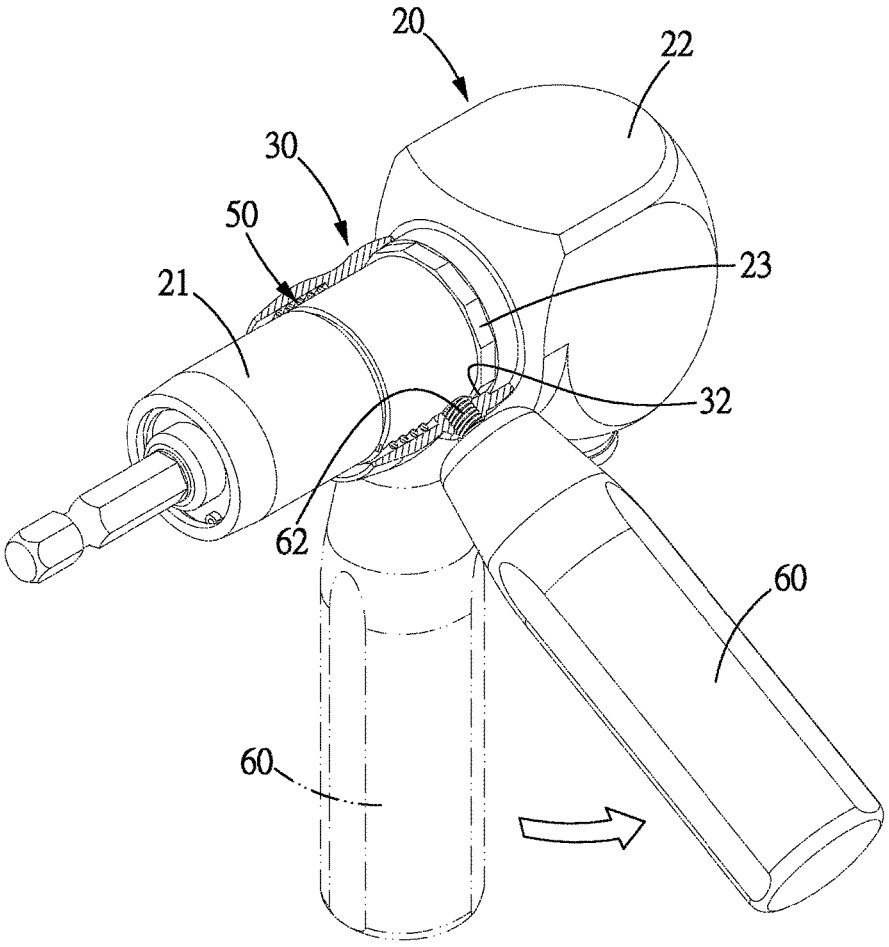
FIG. 8 is another applied view of the first embodiment of the present invention, showing that the auxiliary handle is positioned after rotation.

Referring to FIGS. 7 and 8, release of the auxiliary handle 60 makes the adjusting sleeve 30 move away from the adapting portion 22 of the main body 20. At this time, the spring member 50 uses the accumulated returning resilience to push the adjusting sleeve 30 and the auxiliary handle 60 toward the adapting portion 22 of the main body 20, until the polygonal positioning recess 32 of the adjusting sleeve 30 comes to be engaged with the polygonal positioning portion 23 of the main body 20 again, so that the adjusting sleeve 30 and the auxiliary handle 60 are both prevented from rotate with respect to the main body 20. At last, the auxiliary handle 60 is screwed to tight to make the abutting portion 62 press against the surface of the driving portion 21, thereby preventing the adjusting sleeve 30 from shifting on the driving portion 21 of the main body 20. The angular adjustment between the auxiliary handle 60 and the main body 20 is thus accomplished.

It is to be noted that at the moment when the angular adjustment between the auxiliary handle 60 and the main body 20 has been done and the auxiliary handle 60 does not press against the main body 20, the polygonal positioning recess 32 of the adjusting sleeve 30 is mounted around the polygonal positioning portion 23 of the main body 20. At this time, the adjusting sleeve 30 and the auxiliary handle 60 are both prevented from rotating with respect to the main body 20. In other words, all the components are preliminarily positioned. Thus, in the process that the auxiliary handle 60 is screwed to have its abutting portion 62 pressing against the surface of the driving portion 21, the possibility of angular change between the auxiliary handle 60 and the main body 20 is eliminated, thereby ensuring accurate adjustment and making angular adjustment of the auxiliary handle 60 more convenient.

Figure 10:
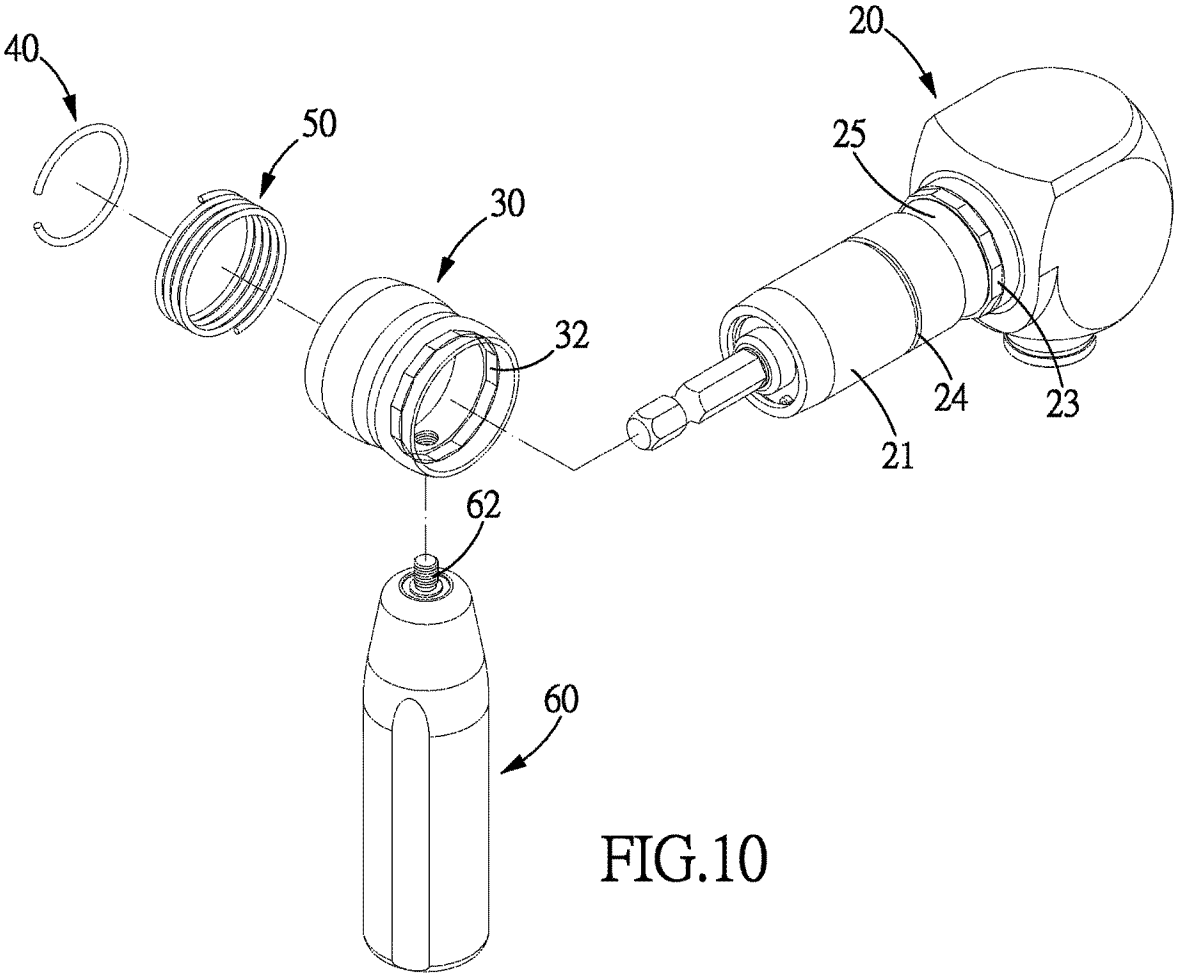
FIG. 10 is an exploded view of the second embodiment of the present invention.
Figure 11:
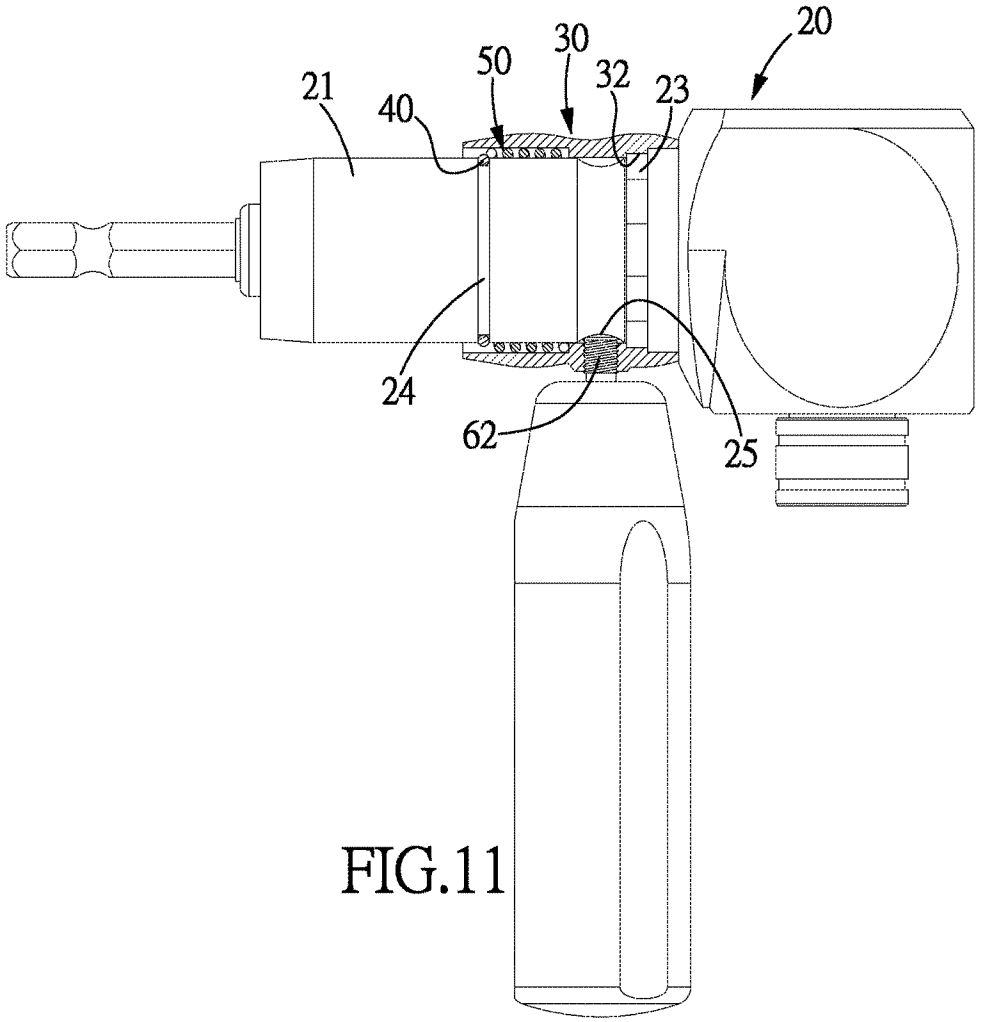
FIG. 11 is a partially sectioned view of the second embodiment of the present invention.

Referring to FIGS. 10 and 11, in the second embodiment of the present invention, the right angle adapter similarly has the main body 20, the adjusting sleeve 30, the retaining member 40, the spring member 50 and the auxiliary handle 60. For those structural features and effects identical to the counterparts of the first embodiment, detailed description is herein omitted but only what makes the second embodiment differ from the first embodiment is explained below.

The main body 20 further has a limiting recess 25 that is depressed from the driving portion 21 and located between the polygonal positioning portion 23 and the peripheral groove 24. When the polygonal positioning recess 32 of the adjusting sleeve 30 is mounted around and engaged with the polygonal positioning portion 23, the limiting recess 25 allows the abutting portion 62 of the auxiliary handle 60 to enter thereto or retract therefrom.

When the abutting portion 62 of the auxiliary handle 60 is screwed into the limiting recess 25 of the main body 20, the auxiliary handle 60 and the adjusting sleeve 30 are both prevented from moving with respect to the main body 20. When the polygonal positioning recess 32 of the adjusting sleeve 30 fittingly receives the polygonal positioning portion 23, the auxiliary handle 60 and the adjusting sleeve 30 are both prevented from moving with respect to the main body 20. In this manner, the present invention better ensures the stability after the angular adjustment between the auxiliary handle 60 and the main body 20.

What is claimed is:

1. A right angle adapter with an auxiliary handle, comprising:

a main body having a driving portion, an adapting portion connected to the driving portion, a polygonal positioning portion peripherally formed around the driving portion, and a peripheral groove that is depressed from the driving portion and is farther from the adapting portion as compared to the polygonal positioning portion;

an adjusting sleeve being movably and rotatably assembled to the main body, and having a socket for receiving the driving portion, a polygonal positioning recess that is depressed from an inner wall of the socket and for disengageably combining with the polygonal positioning portion, a returning recess depressed from the inner wall of the socket, and a threaded hole communicated with the socket and located between the polygonal positioning recess and the returning recess;

a retaining member being mounted around the peripheral groove of the main body and partially raised from the driving portion;

a spring member being mounted around the driving portion and providing the adjusting sleeve with a resilient returning force, the spring member having a first end abutting against the returning recess and a second end abutting against the retaining member raised from the surface of the driving portion; and the auxiliary handle having a grip portion and an abutting portion that is connected to the grip portion and screwed into the threaded hole, wherein the abutting portion is configured to stay apart from or presses against the driving portion;

whereby when the abutting portion of the auxiliary handle leaves from the driving portion, the auxiliary handle drives the adjusting sleeve to move away from the adapting portion of the main body, and makes the spring member accumulate a resilient returning force for later returning the adjusting sleeve, and when the polygonal positioning recess of the adjusting sleeve leaves from the polygonal positioning portion of the main body, the auxiliary handle drives the adjusting sleeve to rotate with respect to the driving portion of the main body, and when the spring member returns the adjusting sleeve, the polygonal positioning recess of the adjusting sleeve is mounted around and engaged with the polygonal positioning portion of the main body, the adjusting sleeve is prevented from rotating with respect to the driving portion of the main body, and when the abutting portion of the auxiliary handle presses against the driving portion, the auxiliary handle is prevented from driving the adjusting sleeve to move away from the adapting portion of the main body.

2. The right angle adapter of claim 1, wherein the polygonal positioning portion of the main body is a dodecagonal positioning portion, and the polygonal positioning recess of the adjusting sleeve is a dodecagonal positioning recess.

3. The right angle adapter of claim 1, wherein the polygonal positioning portion of the main body is an octadecagonal positioning portion, and the polygonal positioning recess of the adjusting sleeve is an octadecagonal positioning recess.

4. The right angle adapter of claim 1, wherein the main body further has a limiting recess that is depressed from the driving portion and located between the polygonal positioning portion and the peripheral groove, so that when the polygonal positioning recess of the adjusting sleeve is mounted around and engaged with the polygonal positioning portion, the limiting recess allows the abutting portion of the auxiliary handle to enter thereto or retract therefrom.

* * * * *